US005921455A

United States Patent [19]

Dickhoff

[11] Patent Number: 5,921,455

[45] Date of Patent: Jul. 13, 1999

[54] STAPLING DEVICE

[75] Inventor: Andreas Dickhoff, Rochester, N.Y.

[73] Assignee: Eastman Kodak Company, Rochester, N.Y.

[21] Appl. No.: 09/179,501

[22] Filed: Oct. 27, 1998

[30] Foreign Application Priority Data

Nov. 26, 1997 [DE] Germany ..... 197 52 285

[51] Int. Cl.[6] ..... B27F 7/28; B27F 7/02

[52] U.S. Cl. ..... 227/86; 227/88; 227/91; 227/97; 227/155

[58] Field of Search ..... 227/129, 131, 227/82, 86, 88, 91, 93, 155, 97; 270/37

[56] References Cited

U.S. PATENT DOCUMENTS

| | | | |
|---|---|---|---|
| 3,735,909 | 5/1973 | Breckenfelder | 227/86 |
| 3,876,129 | 4/1975 | Bulka | 227/88 |
| 3,948,427 | 4/1976 | Claydon et al. | 227/97 |
| 4,318,555 | 3/1982 | Adamski et al. | 227/91 |
| 5,098,002 | 3/1992 | Hansch et al. | 227/88 |
| 5,141,143 | 8/1992 | Ebner et al. | 227/129 |

FOREIGN PATENT DOCUMENTS 38 39 297 A1 5/1990 Germany .

40 20 355 C2 2/1996 Germany .

OTHER PUBLICATIONS

Research Disclosure No. 15710, May 1997, pp. 22–23.

*Primary Examiner*—Scott A. Smith

*Attorney, Agent, or Firm*—Clyde E. Bailey, Sr.

[57] ABSTRACT

A stapling device has a stapler and a staple wire cassette detachably attached directly thereto, in which the leading end of the wire emerging from the staple wire cassette terminates directly in the working region of the stapler. The stapler has a base member serving as a staple-forming and holddown element, on which a driver and a sleeve are guided linearly so as to engage in telescoping fashion within one another, and are movable perpendicular to the upper side of a sheet stack. Compression springs of different spring forces, having the same working direction, engage on the base member, the driver, and the sleeve. The stapler is acted upon by a drive system which is movable in the working direction of the compression springs. The compression springs are associated with the base member, the driver, and the sleeve, and arranged in preloaded fashion thereon, in such a way that upon actuation of the stapler, a force-controlled drive occurs in an operationally correct sequence.

9 Claims, 12 Drawing Sheets

STAPLING DEVICE

FIELD OF THE INVENTION

The invention relates to a stapling device for stapling a stack of sheets by means of staples, in which the staples are formed in the stapling device from wire and then driven into the sheet stack, the wire being stocked in a cassette attached to the stapling device

BACKGROUND OF THE INVENTION

U.S. Pat. No. 5,141,143 titled "Sheet-Stapling Device" dated Aug. 25, 1992, by Ebner et al. discloses a stapling device of the generic type in which the functions necessary for the stapling operation are controlled by a plurality of cams and sliders associated with them. This stapling device is provided in order to bend and drive in wire segments combined in belt form, which are delivered from a cassette detachably attached to the stapling device.

In a stapling device disclosed in Research Disclosure No. 15710 of May, 1977, the staple wire is delivered from a separately arranged supply reel by means of a transport means of the stapling device. At the stapling device, a wire segment is then cut off and formed in the stapling device into a staple, and driven into the sheet stack. This stapling device is provided with a pivotable bending block around which the staple legs are bent, the bending block serving, during the bending operation, as a shape-stabilizing countermember for the staple to be formed. The stapling device is furthermore provided with interlocking means which decouple the driver from the other functional elements in such a way that only the driver is active in order to push the staple through.

The known stapling devices are subject to wear and malfunction due to the use of cams and interlocking means. They are also not suitable for the use of staple wire packaged on a spool, or require a comparatively large installation space for arrangement of a staple wire spool and the pertinent transport means. Because of their complex construction, the known stapling devices moreover entail considerable manufacturing outlay, which raises costs.

SUMMARY OF THE INVENTION

The present invention is directed to overcoming one or more of the problems set forth above. Briefly summarized, according to one aspect of the present invention, a stapling device for stapling a stack of sheets by means of staples, in which the staples are formed in the stapling device from wire and then driven into the sheet stack, the wire being stocked in a cassette attached to the stapling device, the stapler device comprising:

- a stapler and a staple wire cassette attached directly thereto, with staple wire stocked on a reel, the stapler having a base member serving as staple-forming and hold-down element, a driver serving to drive in staples, and a sleeve, which are guided linearly so as to engage in telescoping fashion within one another and are movable perpendicular to the upper side of the stack;
- compression springs of different spring forces, having the same working direction, are associated with the base member, the driver, and the sleeve of the stapler;
- the stapler can be acted upon by a drive system which is movable in the working direction of the compression springs;
- the stapler is mounted displaceably on a stationary guide element, its movable components being at least partially enclosed directly by the guide element;

- the staple wire cassette is attached detachably to the guide element; and on the staple wire cassette, the reel as well as staple wire advance and drive means, a staple wire cutting device, staple wire guide means, and control means for a staple-mounted bending anvil are arranged in combination as a closed subassembly; and
- the leading end of the wire emerging from the staple wire cassette terminates directly in the working region of the stapler.

These and other aspects, objects, features, and advantages of the present invention will be more clearly understood and appreciated from a review of the following detailed description of the preferred embodiments and appended claims, and by reference to the accompanying drawings.

ADVANTAGEOUS EFFECT OF THE INVENTION

Advantageously, the components of the stapling device which engage in telescoping fashion within one another are configured cylindrically and serve to mount the compression springs, so that a compact, space-saving design is achieved. Because the cylindrical components are arranged and mounted on or within a U-shaped guide element to which the staple wire cassette with all its pertinent operating and drive means is directly and detachably attached, the result is a particularly compact design for the entire stapling device.

The advantageous result of the arrangement, configuration, and manner of operation of the compression springs according to the invention is a force-controlled operating sequence for the stapling device, such that when the stapling device is actuated, the temporal sequence of the stapling operation is controlled in operationally correct fashion in a simple manner and with little wear. Because of the force-controlled operating sequence, the stapling device according to the invention is, advantageously, particularly robust and reliable.

Advantageously, each compression spring is arranged in preloaded fashion between those associated subassemblies which are actuated successively in temporal sequence.

The manner in which the individual compression springs become effective is controlled in an advantageous manner in such a way that their spring forces do not add to one another, so that only a relatively low spring preload is necessary for the strongest compression spring.

The fact that the subassemblies of the stapling device are guided in linearly displaceable fashion means that simply constructed components can be used, which are, advantageously, reliable and exhibit little wear. In addition, actuation of the device can be accomplished by means of a drive system of simple design, so that the stapling device as a whole can be produced economically and can be configured in a space-saving manner. In addition, the removability of the staple wire cassette advantageously makes service much easier, since once removed, the staple wire cassette greatly facilitates staple wire loading, inspection of functional elements, and replacement of worn parts. Advantageously, the staple wire cassette can also be exchanged in its entirety for a new one, so that inspection and loading of the staple wire cassette after removal can be accomplished at a central service location.

Further features and advantages are evident from the description of an embodiment of the invention depicted in the drawings, and from the claims.

BRIEF DESCRIPTION OF THE DRAWINGS

To facilitate understanding, identical reference numerals have been used, where possible, to designate identical elements that are common to the figures.

DETAILED DESCRIPTION OF THE INVENTION

Figure 1:
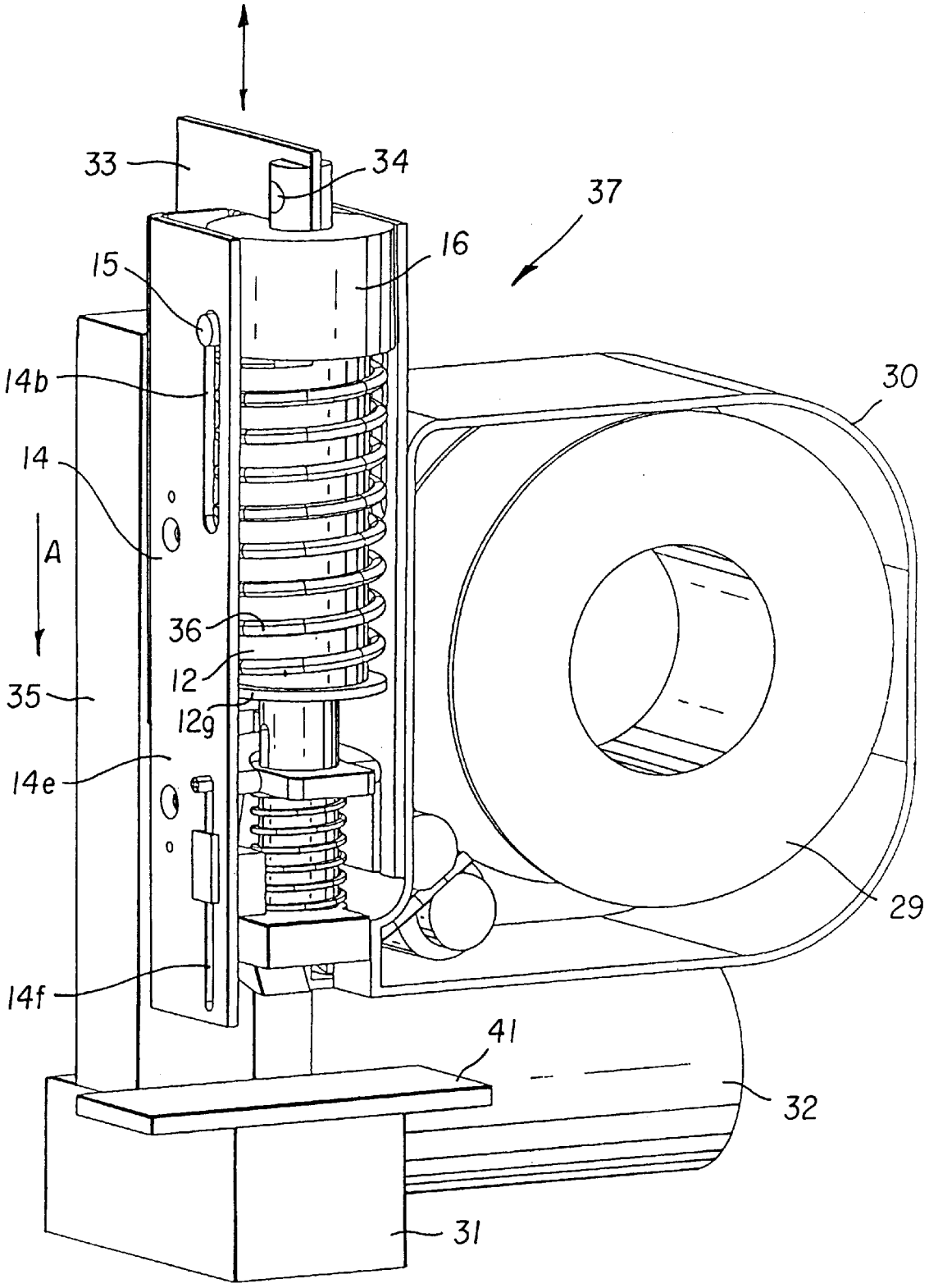
FIG. 1 shows an overall view of the stapling device, partly in section.

FIG. 1 shows the overall construction of a stapling device, of which, in order to simplify the description, only those components essential to the invention are depicted and explained. Other generally known drive and/or guide means necessary for operation of the stapling device are depicted only schematically, and described only in general fashion. As shown in FIG. 1, the stapling device substantially comprises a stapler 37, a staple wire cassette 30, a bending device 31, a sheet collecting station for arrangement of a sheet stack 41 to be stapled, and a drive motor 32, which are together attached to a holder 35. Holder 35 is in turn arranged, for example, on a unit (not depicted) for collection and stapling sheets in stacks, and for delivery of stapled sheet products. A unit of this kind is known, for example, from DE 38 39 297 A1. Stapler 37 has a guide element 14, visible in particular in FIGS. 1 and 2, which has a U-shaped configuration running perpendicular to the sheet collecting station and to sheet stack 41. Mounted on guide element 14 are components of stapler 37, which are movable in the direction of the arrow "A." Said components will be described below.

Figure 3:
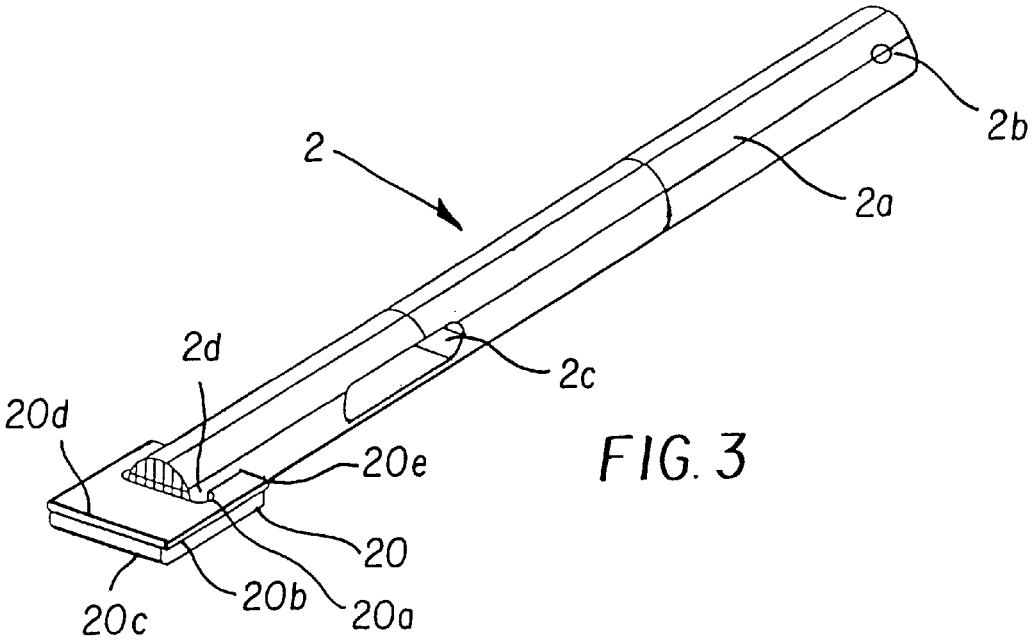
FIGS. 3, 4, and 8 show details of components of the device according to FIG. 2.
Figure 4:
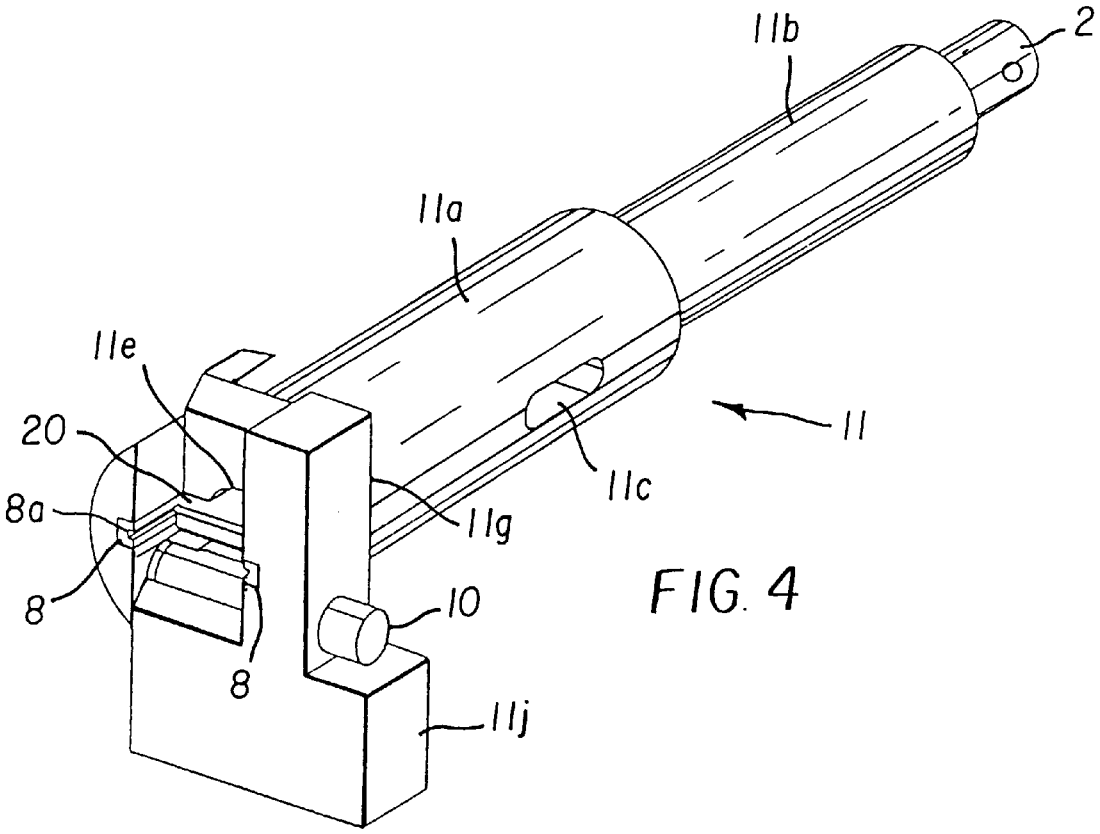

A cylindrically configured base member 11, visible in particular in FIG. 4 and serving as a staple-forming and holddown element, has a first section 11*a* with a larger diameter and a second section 11*b*, adjacent thereto, with a smaller diameter. Base member 11 is provided in its longitudinal direction with a concentric bore 11*e* in which driver 2, serving as the staple driver, is displaceably guided. The driver 2 which has a cylindrical circumferential surface 2*a* (see FIG. 3) comprises at its one, lower end an insert 20 which is positively attached to said driver 2 and is arranged in an end face slot 11*i* of base member 11 (see FIG. 5). The Insert 20 has an opening 20*a* into which a hook-shaped projection 2*d* of driver 2 engages positively (see FIG. 3). At its end face, base member 11 is provided with a conformation, visible in FIG. 4, which hereinafter will be referred to as extension 11*j*. First section 11*a* of base member 11, and driver 2 each comprise a longitudinal groove 11*c*, 2*c* respectively, which align with one another in their longitudinal direction and into which a bolt 6, yet to be described, engages. Longitudinal groove 2*c* is longer than longitudinal groove 11*c*.

Figure 5:
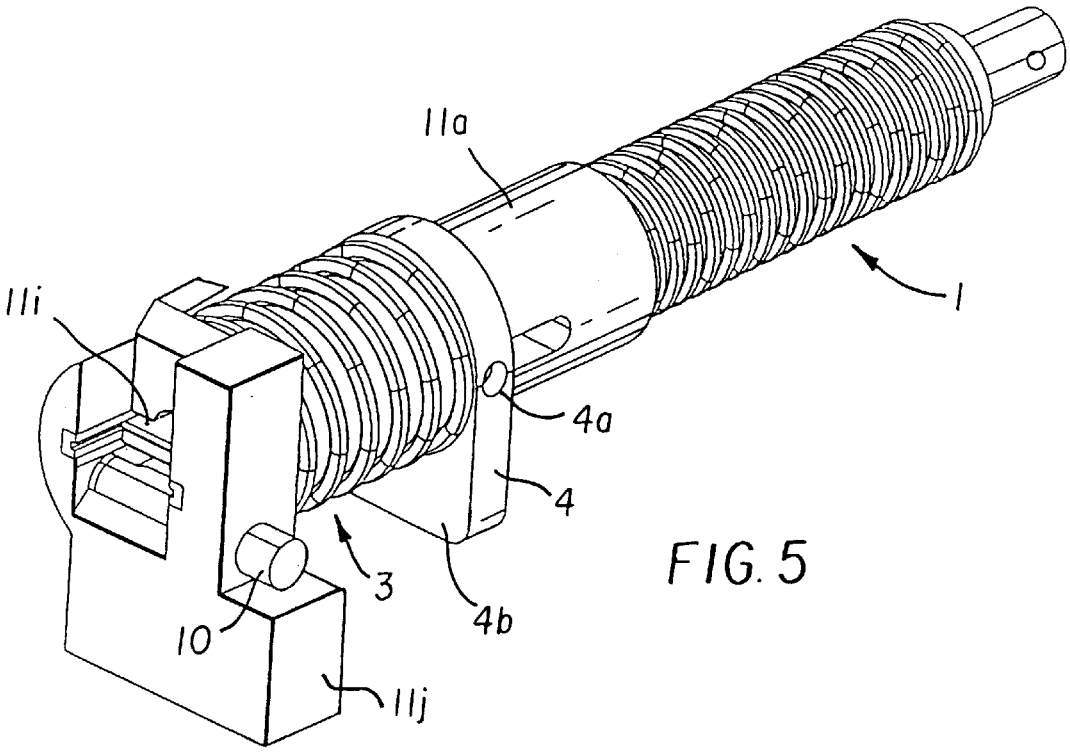
FIGS. 5, 6, 7, and 9 show different assembly states of the device according to FIG. 2.

As shown by FIG. 5 in particular, there is mounted on section 11*a* of base member 11 compression spring 3 with a moderate preload force C2 yet to be described, which is arranged in preloaded fashion between a rear end surface 11*g* of extension 11*j* (see FIG. 4) and an end surface 4*b* of a mounting element 4. Arranged on second section 11*b* which is continuous therewith is a compression spring 1 with a preload force C1 which is less than that of compression spring 3.

Figure 8:
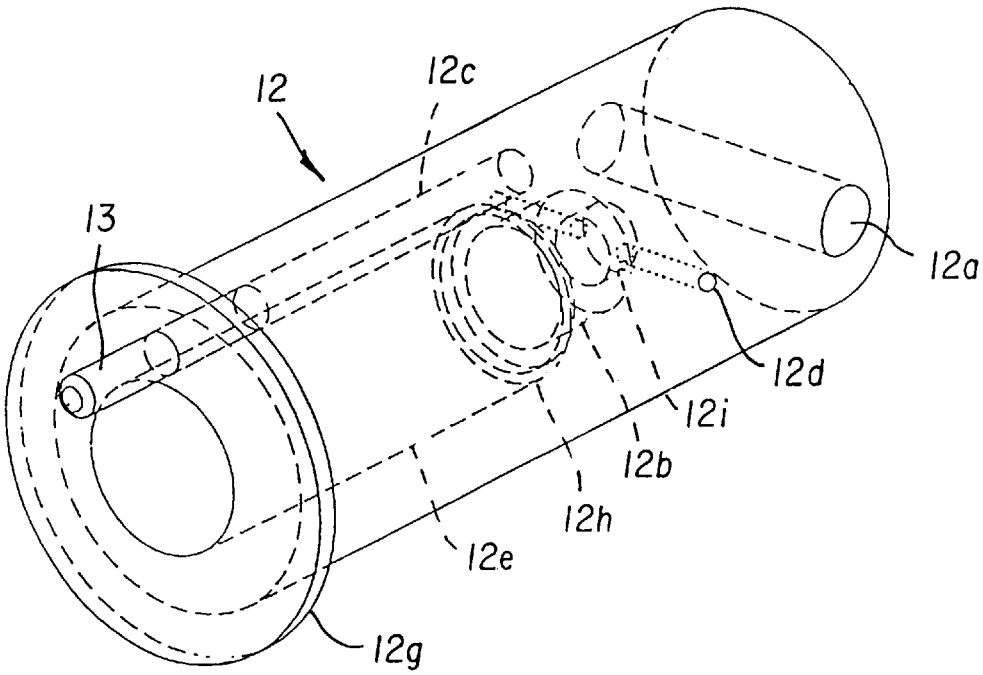

A cylindrical sleeve 12 (see FIGS. 8 and 9) having a collar 12*g* and a concentric bore 12*e* by means of which sleeve 12 is mounted positively and displaceably on first section 11*a*, is arranged on first section 11*a* of base member 11. Arranged on sleeve 12 is a compression spring 36 (see FIG. 2) which has a preload force C3 greater than that of compression spring 3. Compression spring 36 is arranged in preloaded fashion between collar 12*g* of sleeve 12 and the inner end face 12*h* of sleeve 12. The dimensions of commercially available compression springs 1, 3, and 36 are defined as a function of the thickness of sheet stack 41 to be stapled, and of the nature of the sheet and/or film material to be stapled, such that, for example, compression spring 1 has a preload force C1 of 20 N, compression spring 3 has a preload force C2 of 80 N, and compression spring 36 has a preload force C3 of 250 N. If only thin sheet stacks are to be stapled, a preload force of 120 N may then also be sufficient for compression spring 36.

Referring back to FIG. 8, arranged as an extension to concentric bore 12*e* is a concentric bore 12*b* into which second section 11*b* of base member 11 penetrates. Arranged as an extension to concentric bore 12*b* is a depression 12*i* into which the other, upper end of driver 2 engages. A pin, not depicted, which absorbs the preload of compression spring 1 via sleeve 12 engages into a transverse bore 12*d* of sleeve 12 and into a transverse bore 2*b* of driver 2 (see FIG. 3). Sleeve 12 has a further transverse bore 12*a* into which engages a pin 15 which, inserted through elongated holes, not depicted, of a head element 16 (see FIGS. 1 and 2) slipped over sleeve 12, joins sleeve 12 to head element 16 in such a way that compression spring 36 is arranged with a preload between head element 16 and collar 12*g* of sleeve 12. Pin 15 engages, with its ends projecting out of head element 16, into upper elongated slots 14*a*, 14*b* of guide element 14. Head element 16 is provided with lateral flattened areas 16*a* and 16*d* which provide guidance along the lateral webs 14*d*, 14*e* for guide element 14.

Figure 2:
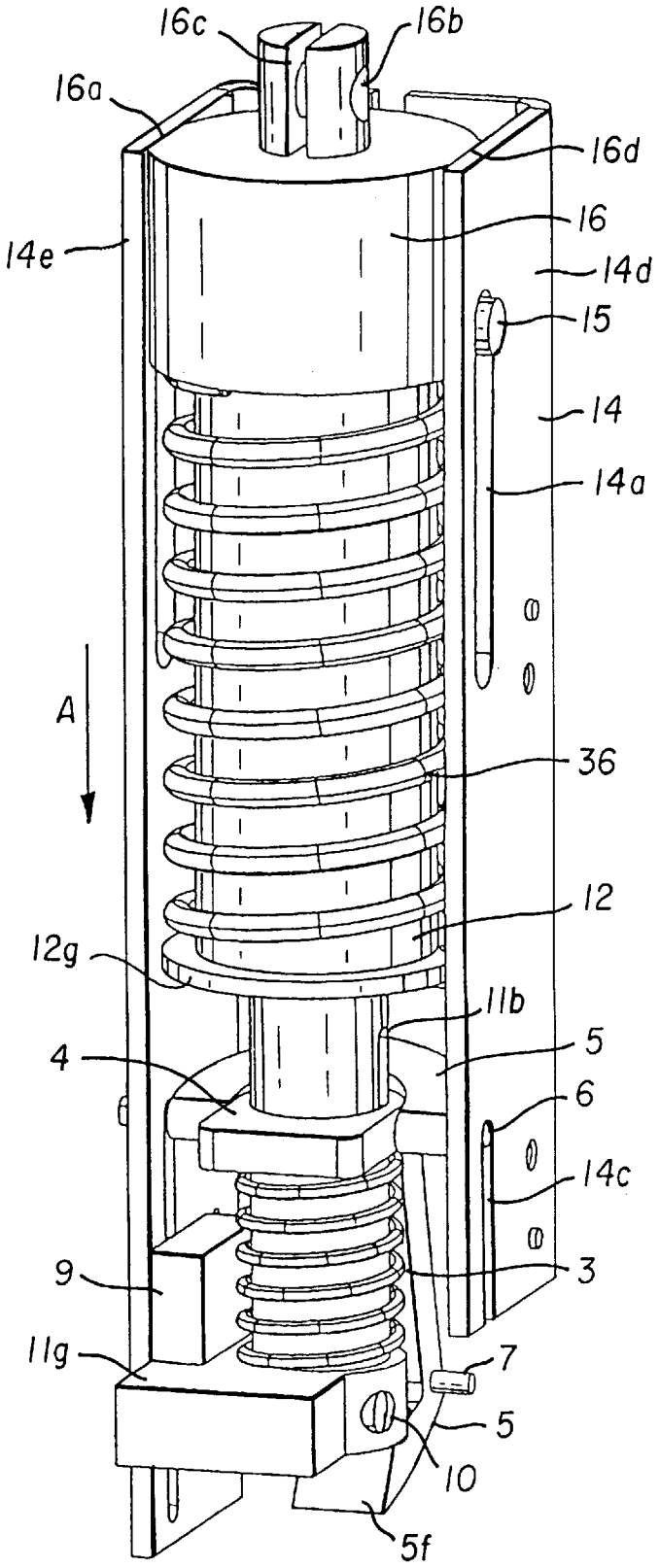
FIG. 2 shows a partial view of the device according to FIG. 1.

Arranged on the upper side of head element 16, as shown in FIG. 2, is a slot 16*c* into which engages an upper end of a slider 33 (see FIG. 1 ) which is joined to head element 16 by means of a pin 34 pressed into a transverse bore 16*b*. Slider 33, which is guided displaceably in the direction of the arrow "A" on holder 35, is part of a drive device of a known type, not described further, driven by drive motor 32.

In the lower region, stapler 37 is guided on longitudinal slots 14*c* and 14*f* (FIGS. 1 and 2) of guide element 14, into which the ends of bolt 6 engage positively. Bolt 6 which is pressed into a bore 4*a*, visible in FIG. 5, of mounting element 4 and engages into longitudinal grooves 2*c* and 11*c* (FIGS. 2 and 3), also serves to mount and guide mounting element 4 which is arranged displaceably on first section 11*a* of base member 11.

Figure 6:
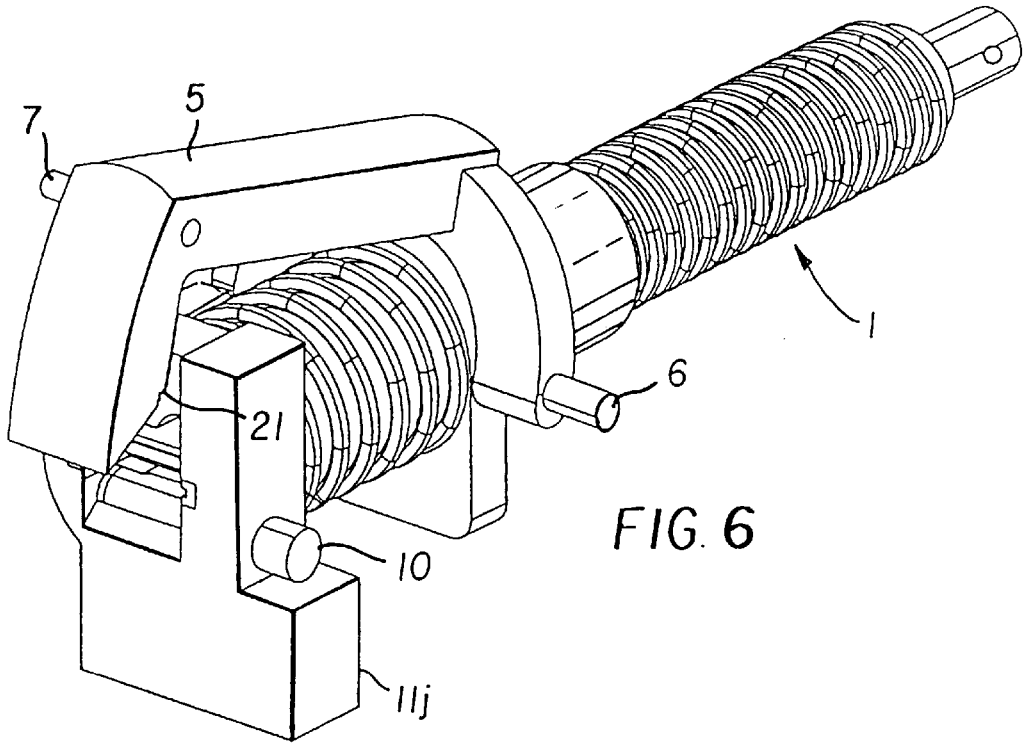
Figure 7:
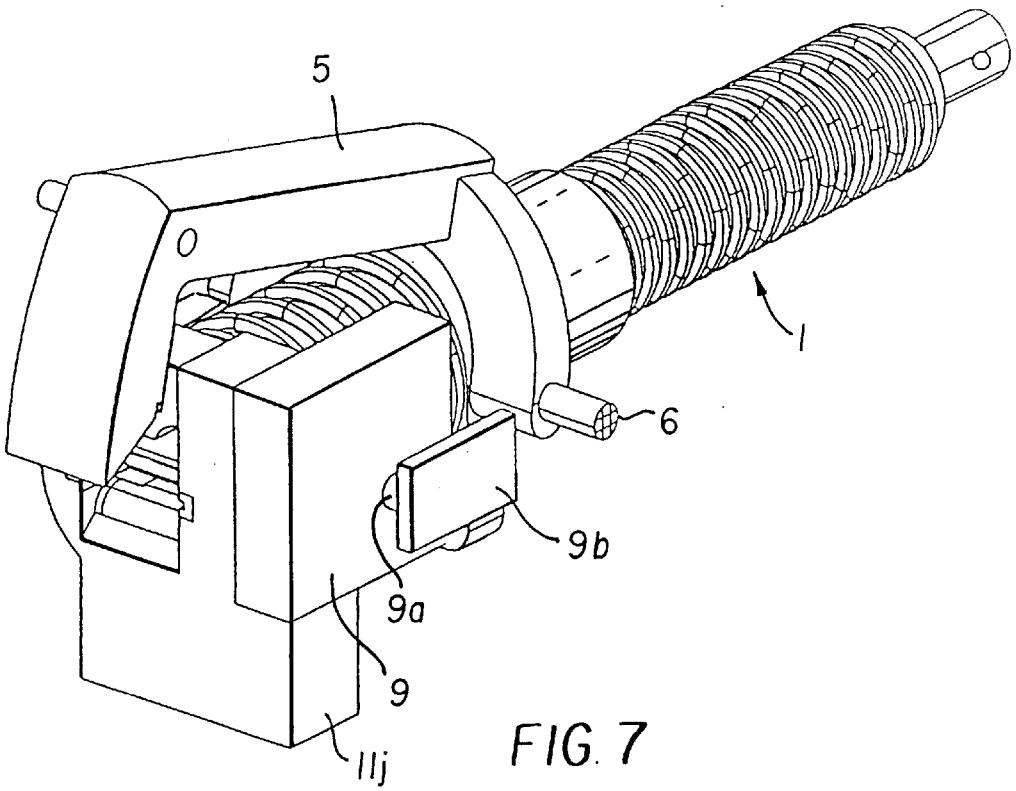
Figure 9:
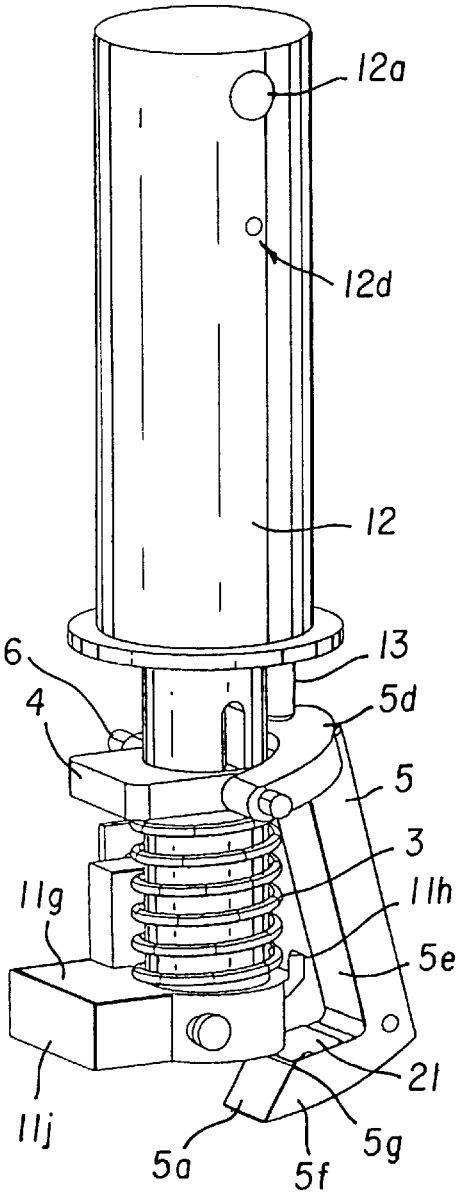
Figure 11:
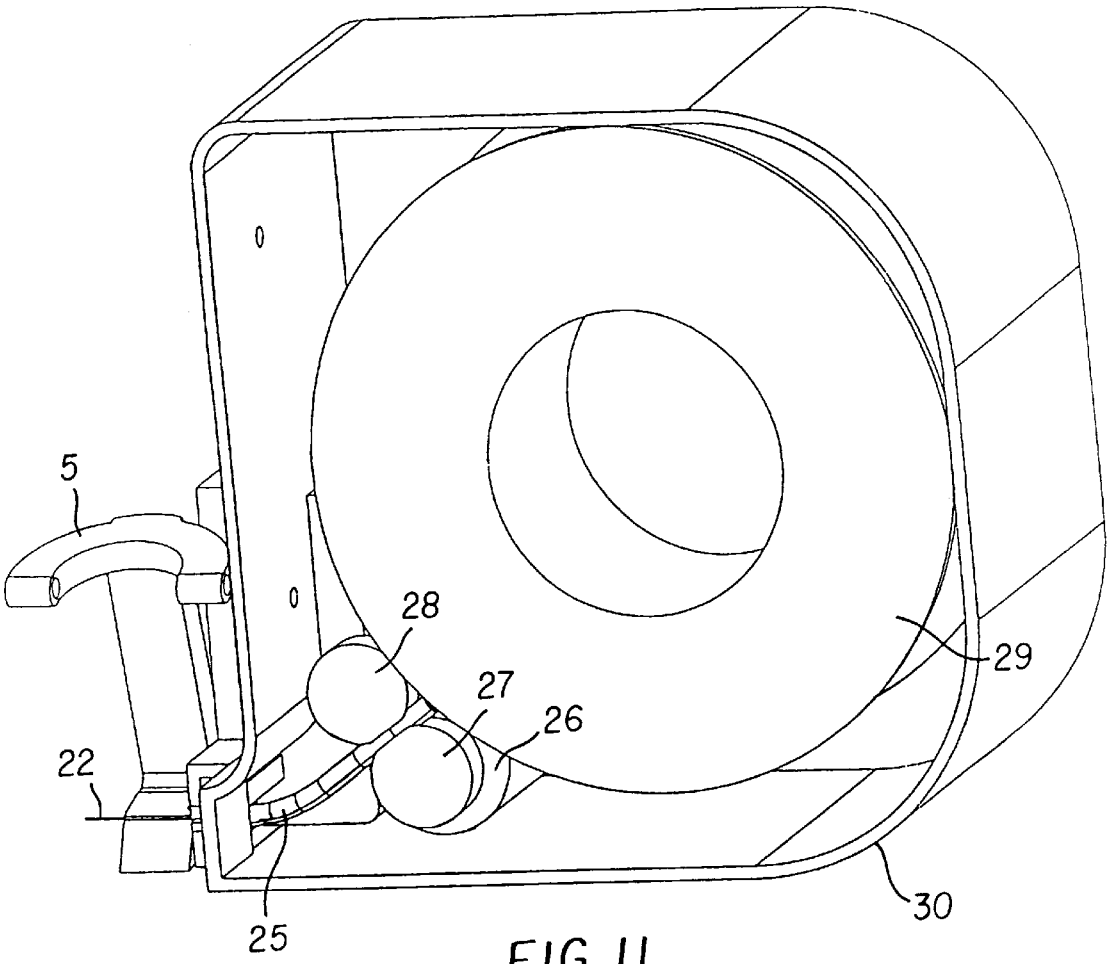
FIG. 11 shows details of the staple wire cassette according to FIG. 1.
Figure 12:
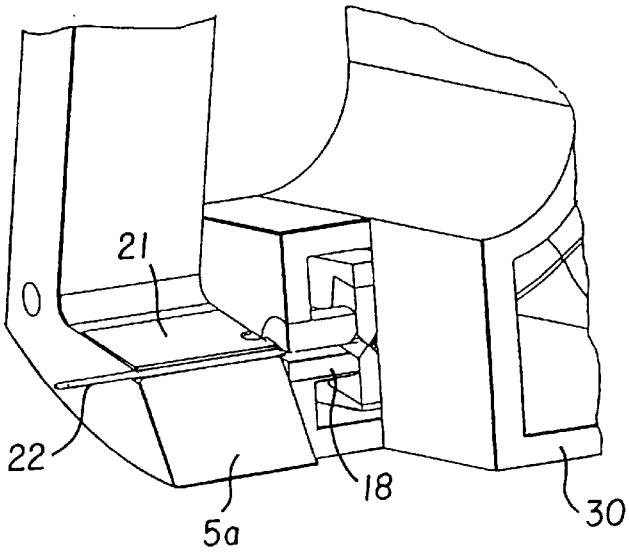
FIG. 12 shows the transition region from the staple wire cassette to the stapling device according to FIG. 1.
Figure 14:
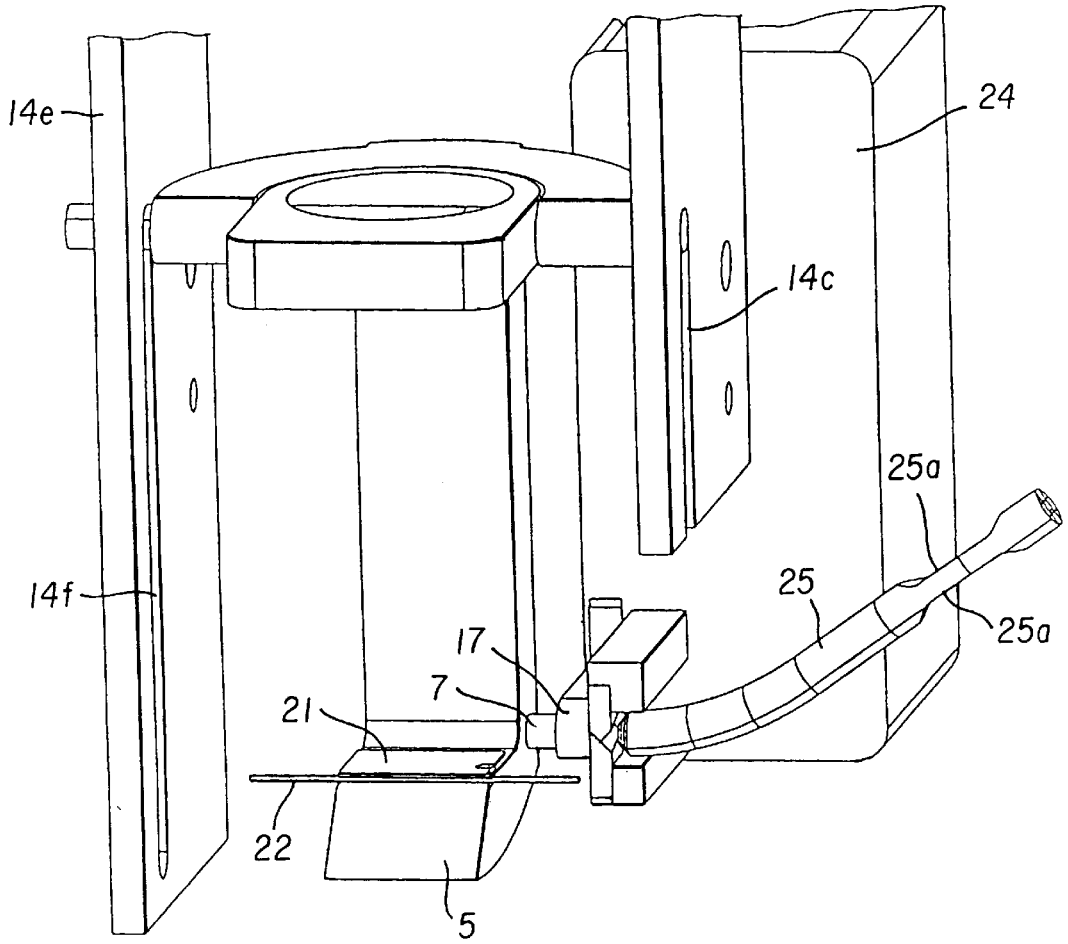
FIGS. 14, 15, and 16 show details of the positioning of the staple wire segment.
Figure 15:
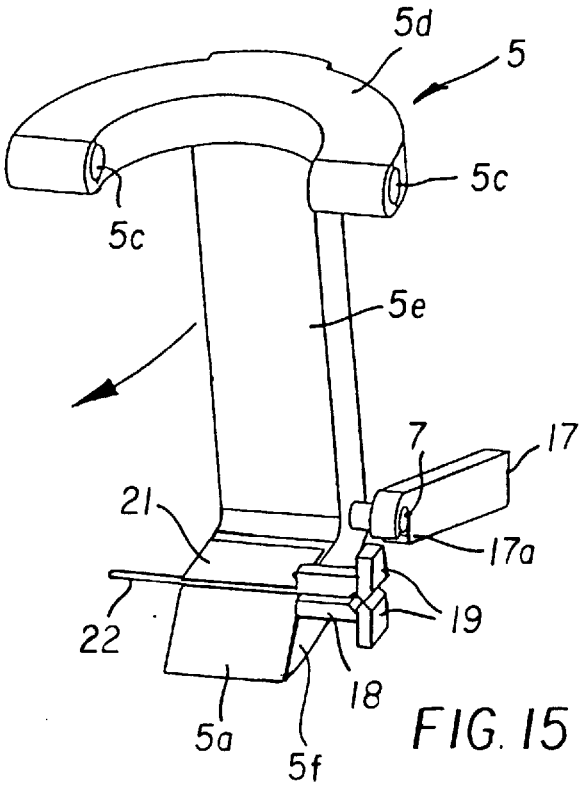
Figure 16:
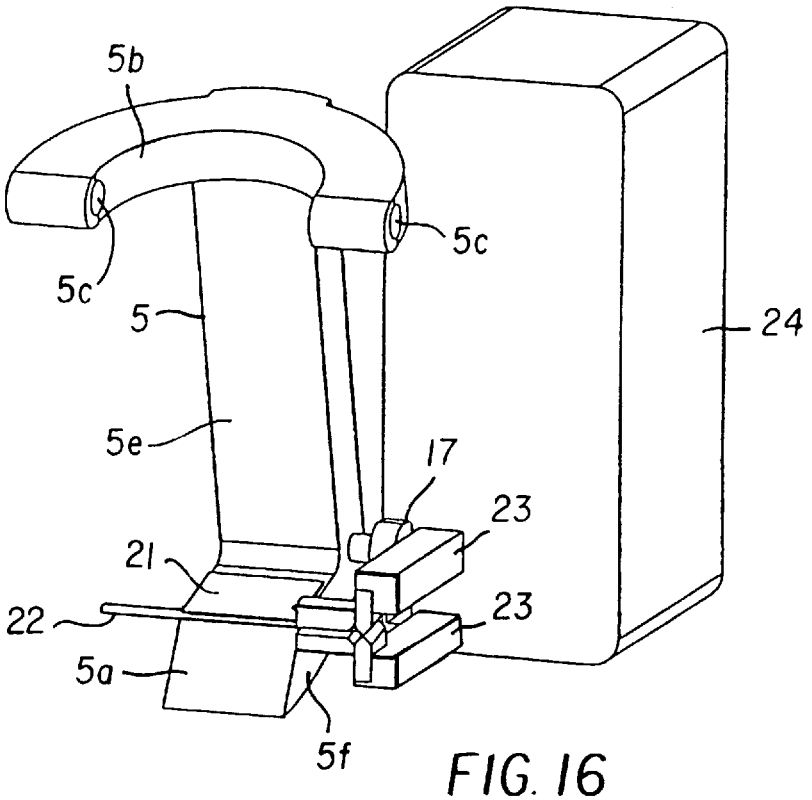

As is evident from FIGS. 6, 7, and 9, a bending anvil 5 is mounted pivotably on bolt 6. Bending anvil 5, visible in particular in FIGS. 15 and 16, has a yoke 5*b* in the shape of a circular segment, on which bores 5*c* are arranged for mounting on bolt 6. Shaped onto yoke 5*b* is an L-shaped arm 5*e* which fits around the region of compression spring 3 (see FIG. 2) and projects, with a region serving as anvil 5*f,* into the working region of stapler 37. Attached to the upper side of anvil 5*f* is a sheet-metal spring 21 which overlaps a step-shaped groove 5*g* (see FIG. 9) which is arranged in this region and is dimensioned so that a staple wire segment 22 (FIGS. 11, 12, and 14) arranged therein is held. The front end face of anvil 5*f* is provided with an oblique surface 5*a* evident.

Referring to FIGS. 3 and 4, two inserts 8 made from hardened steel, into which guide grooves 8*a* are recessed, are injection molded into extension 11*j* of base member 11, which is made of plastic. Engaging positively into said guide grooves 8*a* are correspondingly configured guide lands 20*b* of insert 20 of driver 2, said lands being made of hardened steel. Also inserted into extension 11*j* is a steel bolt 10 which coacts with oblique surface 5*a* of bending anvil 5.

Figure 10:
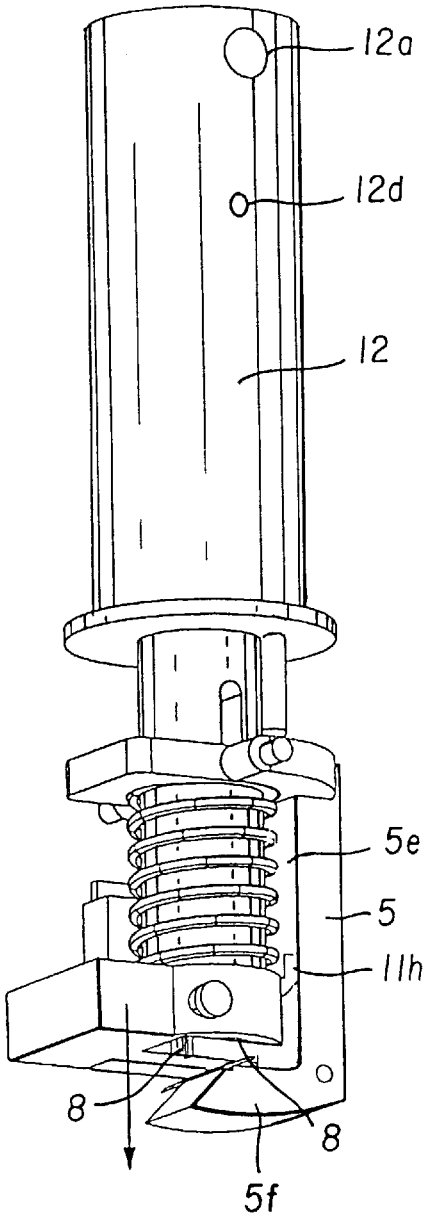
FIG. 10 shows the device according to FIG. 9, in its bending position.

Referring to FIGS. 9 and 10, a spring-loaded pin 13 which is guided displaceably in a bore 12*c* of sleeve 12, engages on an upper surface 5*d* of bending anvil 5. A projection 11*h,* arranged on extension 11*j* of base member 11, serves as a stop to determine the bending position of bending anvil 5. Also attached to extension 11*j* is a guide element 9 (shown clearly in FIG. 7) to which is attached—in a manner not depicted, e.g. by means of a snap connection—a T-shaped insert 9*a,* 9*b* engaging positively into longitudinal slot 14*f* of guide element 14. Guide element 9 rests with its relatively large surface against the inner side of lateral web 14*e* of guide element 14, and is held in its position by insert 9*a,* 9*b,* thus ensuring reliable guidance of base member 11.

Figure 13:
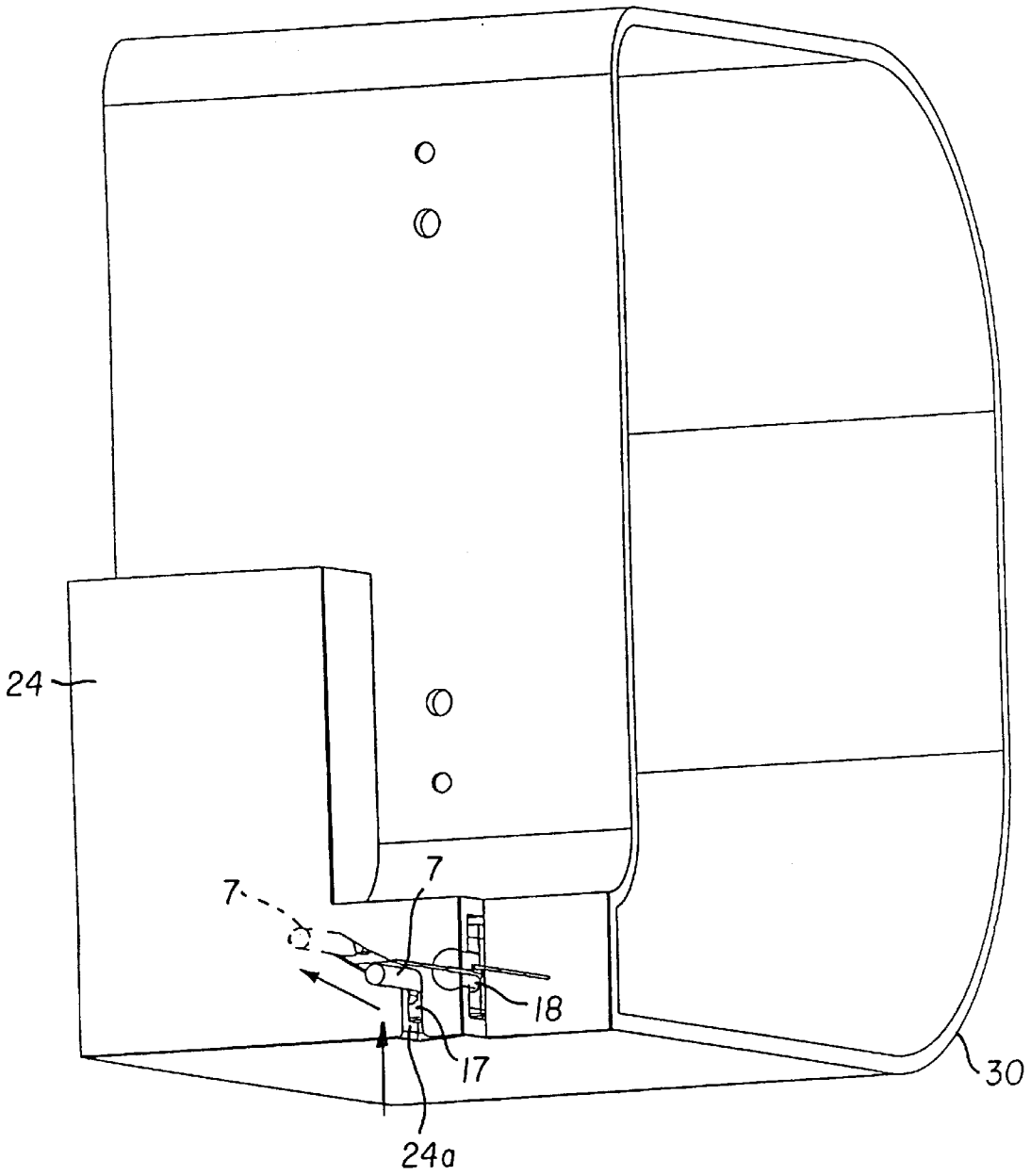
FIG. 13 shows the staple wire cassette in a side view.

Referring to FIGS. 11–14, staple wire cassette 30, attached to the stapling device 37, has the conformation visible from FIG. 13, and is closed off by a cover portion not depicted. As is evident from FIG. 11, all the means necessary for transporting the staple wire and cutting it to length are located, along with the supply of staple wire, in or on staple wire cassette 30. The staple wire is arranged on a reel 29 mounted rotatably in staple wire cassette 30. The leading end of the staple wire is guided through a guide tube 25 to a guide bushing 18 which leads to the exterior of staple wire cassette 30. Guide tube 25 has openings 25*a* arranged on either side (see FIG. 14), through which transport rollers 27, 28 are in engagement with staple wire 22. Transport rollers 27, 28 are driven by a drive motor 26 arranged inside staple wire cassette 30.

Referring now to FIGS. 13–16, a drive device, not shown, which is arranged in a housing element 24 belonging to staple wire cassette 30, serves to move a cassette-mounted arm 17 and to actuate cassette-mounted knives 19 for cutting the staple wire 22 to length. Arm 17 is hook-shaped at its end 17*a,* said end 17*a* being movable behind a gate-shaped opening 24*a* of staple wire cassette 30. Through said opening 24*a,* a pin 7 attached to bending anvil 5 engages positively into hook-shaped end 17*a* of arm 17. Cutting knives 19 are attached to holders 23, one of which is movable in a manner not depicted by means of the cassette-mounted drive system in such a way that a staple wire 22 arranged between the cutting knives 19, provided with wedge-shaped edges, is cut off, forming a wedge-shaped cut edge.

Figure 17:
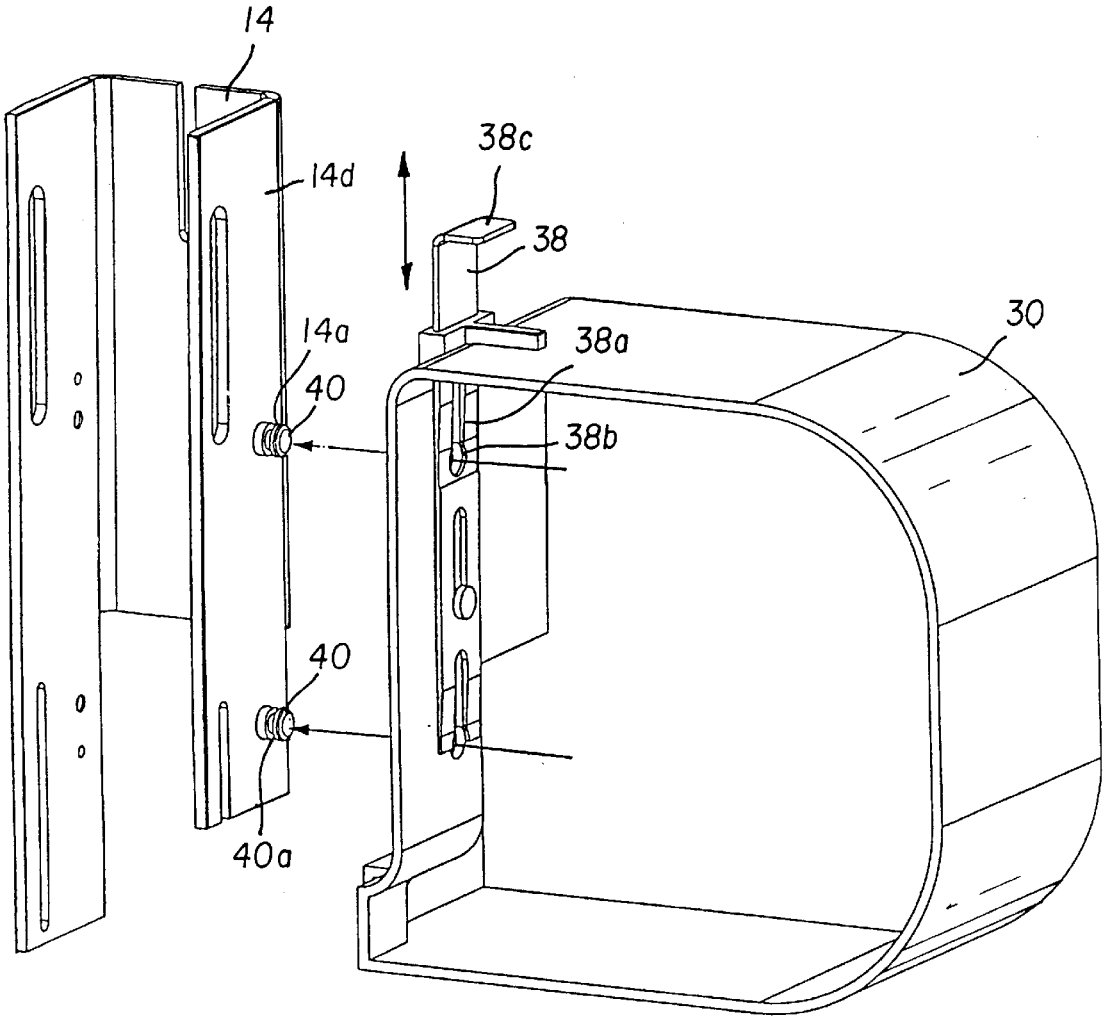
FIGS. 17 and 18 show the attachment means of the staple wire cassette.

Referring to FIG. 17, the staple wire cassette 30 is secured to the side plate 14*d* of guide element 14, to which two bolts 40, provided with an annular groove 40*a,* are attached. The interlocking means of staple wire cassette 30 comprise a displaceably mounted slider 38 which is provided with elongated holes 38*a* engaging into annular grooves 40*a,* and with openings 38*b* for the passage of bolts 40. For attachment, staple wire cassette 30, with slider 38 pulled out as shown, is set in place so that bolts 40 engage into openings 38*b*. Slider 38 is then grasped at its handle 38*c* and pushed in so that elongated holes 38*a* engage into annular grooves 40*a* of bolts 40, thus locking staple wire cassette 30 in its operating position. Wedge surfaces, not depicted, which are arranged on slider 38 wedge the slider 38 in place when it is pushed in, so that it is nonpositively locked. When staple wire cassette 30 is put in place, hook-shaped end 17*a* of cassette-mounted arm 17 comes into engagement with pin 7 of bending anvil 5 (shown clearly in FIG. 15).

Figure 18:
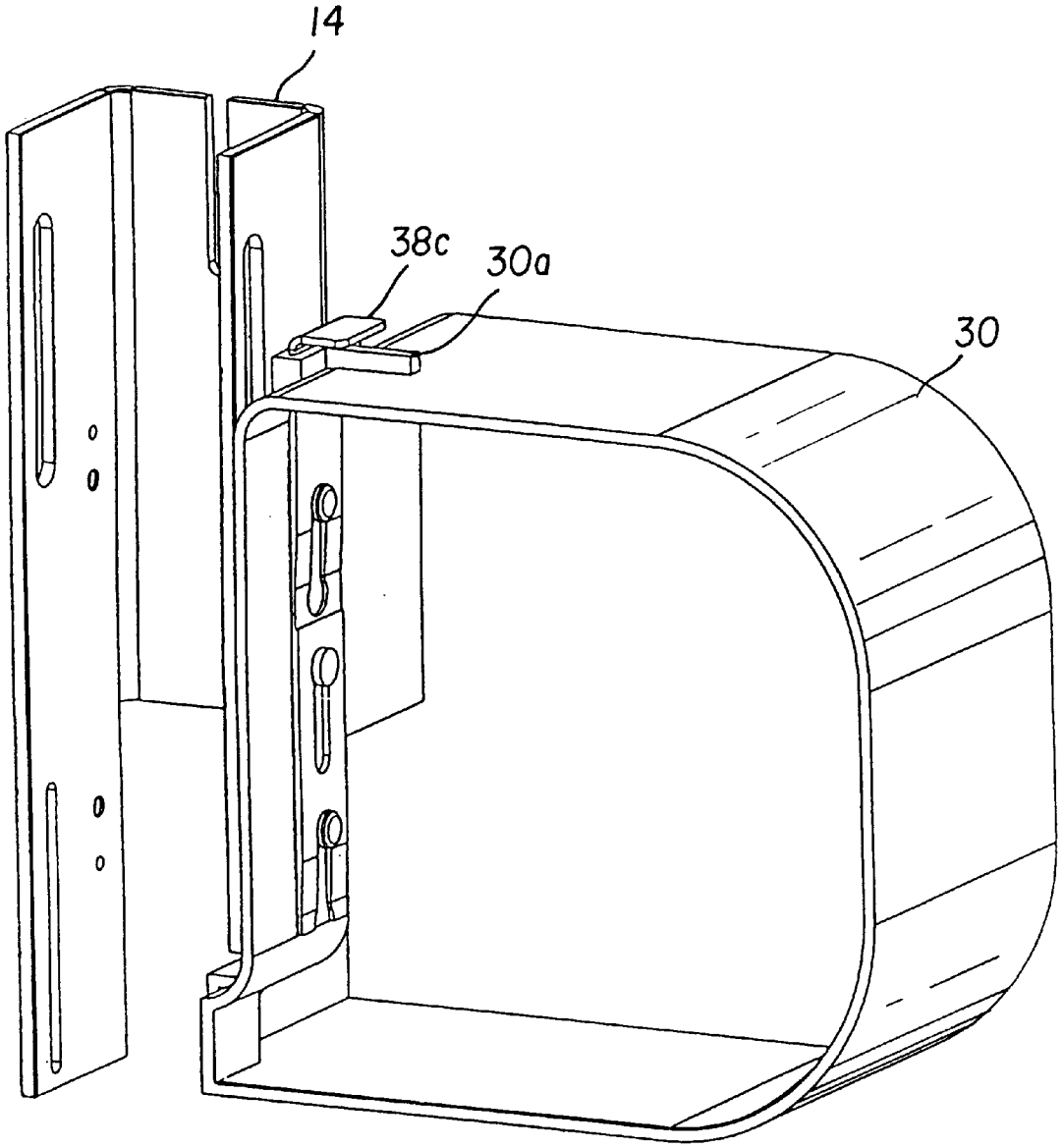

Referring to FIG. 18, to release the non-positive locking of staple wire cassette 30, a screwdriver is applied between a strut 30*a* of staple wire cassette 30 and handle 38*c* of slider 38 to lever slider 38 upward.

Referring to FIG. 1, in operations, the stapling device assumes an initial position in which a full staple wire cassette 30 is put in place on stapler 37. In the collecting station of the unit, a sheet stack 41 to be stapled is positioned in aligned fashion by means not depicted. The staple wire 22 wound onto reel 29 lies with its leading end at the cutting edge of knives 19, and is held in this position by transport rollers 27 and 28. Stapling device 37 is operated by means of a control device, not depicted, of a known type which ensures functionally correct execution. When drive motor 32 is set in motion, slider 33 moves downward in the direction of the arrow "A." Compression spring 36 with the highest preload is thereby moved by means of head element 16, displacing sleeve 12 in the direction of the arrow "A" and thus entraining driver 2 with insert 20.

In the initial position as shown in FIG. 1, compression spring 3, provided with a moderate preload, pushes mounting element 4 and bending anvil 5 upward, so that its bolt 6 rests against the upper end of longitudinal slots 14*c* and 14*f* of guide element 14. The other end of compression spring 3, resting against the rear end surface 11*g* of base member 11, pushes base member 11 downward in the direction of the arrow "A," bracing it against rear face 20*e* (FIG. 3) of insert 20 of driver 2, which in turn is secured to head element 16 by pinning. Because of this association, during the motion of sleeve 12 in the direction of the arrow "A" a relative motion takes place between base element 11 and bending anvil 5 until bolt 6 strikes against the upper end of longitudinal groove 11*c* of base element 11. During this relative motion in which base element 11 and thus also its extension 11*j* move downward in the direction of the arrow "A," staple wire 22 is advanced by transport rollers 27, 28 into the position depicted in FIGS. 11, 12, 15, and 16. In this motion phase of stapler 37, bending anvil 5 is located in a position defined by pin 7 and arm 17, in which bending anvil 5 is arranged in a swung-back position shown in FIGS. 9, 11, 12, 15, and 16. In this position, step-shaped groove 5*g* on anvil 5*f* of bending anvil 5 aligns with guide bushing 18 having a channel opening toward the front, and with staple wire 22 emerging therefrom. Wire section 22 transported out of staple wire cassette 30 is pushed, in the manner depicted, into step-shaped groove 5*g* and is held in position there by sheet-metal spring 21 once the necessary cut-off segment of wire has been cut off by knives 19.

Once wire segment 22 has been prepared in the manner depicted, pin 7 is released by lever 17 so that pin 7 can move during the further motion of stapler 37, along openings 24*a* in housing element 24. In the process, pin 13 mounted in spring-loaded fashion on sleeve 12 becomes active and pivots bending anvil 5 into the bending position shown in FIGS. 10 and 14. The end position of this pivoting motion is reached when arm 5*e* of bending anvil 5 makes contact against a projection 11*h* of base member extension 11*j* (see FIGS. 9 and 10). Anvil 5*f* now assumes its bending position, in which the cut-off wire segment 22 is positioned in alignment with guide grooves 8*a* of inserts 8.

During the further relative motion of base member 11, the end faces of inserts 8, which are injection molded onto extension 11*j*, strike against wire segment 22, bend the wire ends downward around anvil 5*f*, and in the process pull the bent-down wire ends into guide grooves 8*a* of inserts 8. The force required to bend the wire ends of wire segment 22 is applied by compression spring 3. At the end of the bending operation, bolt 10 in extension 11*j* strikes oblique surface 5*a* of anvil 5*f* and deflects bending anvil 5 backward just sufficiently that the completed bent staple, which is now fixed in position by guide grooves 8*a*, moves away from sheet-metal spring 21. At the end of the relative motion just described, the spring force of compression spring 3 is absorbed by rear end surface 11*g* and by the upper end of longitudinal groove 11*c* of base member 11, against which bolt 6 is then resting.

Upon further motion in the direction of the arrow "A," the entire stapler 37 then moves downward along guide element 14 as long as base member 11 and extension 11*j* do not experience any resisting force from below which is greater than the preload force of spring 1. This does not occur until base member 11 is resting with its extension 11*j* on paper stack 41. Base member 11 then remains stationary, while driver 2 with its insert 20 continues to be moved by driven head element 16. The staple is thereby driven by insert 20 of driver 2, which is being moved in the direction of the arrow "A," into sheet stack 41. During the driving-in operation, anvil 5*f* acts as countermember for the staple being acted upon by end face 20*c* of insert 20 (FIG. 3), so that the staple, additionally guided in guide grooves 8*a* of inserts 8 and delimited by land 20*d* projecting beyond end face 20*c* of insert 20, can be driven in in dimensionally stable fashion. This driving-in operation takes place under the action of compression spring 36 which is provided with the greatest preload force. During the driving-in operation, anvil 5*f* of bending anvil 5 is progressively deflected backward by means of its oblique surface 5*a*, directly by insert 20 of driver 2 or by the staple moved by it, out of the movement path of the staple. The driving-in operation is complete when driver 2 with its insert 20 is braced on the surface of sheet stack 41, with bolt 6 at the end of the longer groove 2*c* of driver 2.

To terminate the complete stroke of slider 33, stapler 37 continues to be acted upon in the direction of the arrow "A." Since driver 2 can no longer move, the preload force of compression spring 36 is overcome so that the latter is compressed by means of head element 16 moved by slider 33, so that a motion compensation can take place in order to account for paper stacks of different thicknesses. Immediately after completion of the driving-in operation, the staple ends projecting out of the underside of the sheet stack are laid against the underside of sheet stack 41, in known fashion, by a bending device 31 not depicted in further detail. After the conclusion of the stapling operation described above, slider 33 is moved upward opposite the direction of the arrow "A," causing the components of stapler 37 to move back into their initial positions in reverse order. During this return motion, driver 2, via its groove 2*c*, pulls bolt 6 upward until the latter strikes against the upper ends of lower longitudinal slots 14*c* and 14*f*. During the return motion of driver 2, the latter entrains base member 11 into its initial position by means of a rear end face 20*e* of its insert 20. Compression spring 3 is compressed in the process, thereby storing energy for the next bending operation. When stapler 37 arrives in its top initial position, bending anvil 5 is then moved via its pin 7 by means of cassette-mounted arm 17 into its rear position as shown in FIG. 9, in which stapler 37 is ready for another delivery of staple wire and a further stapling cycle.

The invention has been described with reference to a preferred embodiment; However, it will be appreciated that variations and modifications can be effected by a person of ordinary skill in the art without departing from the scope of the invention.

What is claimed is:

1. Stapling device for stapling a stack of sheets by means of staples, in which the staples are formed in the stapling device from wire and then driven into the sheet stack, the wire being stocked in a cassette attached to the stapling device, the stapler device comprising:

a stapler and a staple wire cassette attached directly thereto, with staple wire stocked on a reel, the stapler having a base member serving as staple-forming and hold-down element, a driver serving to drive in staples, and a sleeve, which are guided linearly so as to engage in telescoping fashion within one another and are movable perpendicular to the upper side of the stack;

compression springs of different spring forces, having the same working direction, are associated with the base member, the driver, and the sleeve of the stapler;

the stapler can be acted upon by a drive system which is movable in the working direction of the compression springs;

the stapler is mounted displaceably on a stationary guide element, its movable components being at least partially enclosed directly by the guide element;

the staple wire cassette is attached detachably to the guide element; and on the staple wire cassette, the reel as well as staple wire advance and drive means, a staple wire cutting device, staple wire guide means, and control means for a staple-mounted bending anvil are arranged in combination as a closed sub-assembly; and the leading end of the wire emerging from the staple wire cassette terminates directly in the working region of the stapler.

2. Stapling device as defined in claim 1, wherein the bending anvil is movable into the infeed region of the staple wire and into the staple-forming and driving region of the stapler.

3. Stapling device as defined in claim 1, wherein the base member has a cylindrical shaft, arranged in its direction of movement, with a first, lower and a second, upper region, which are arranged one behind another in its longitudinal axis, the second region having a smaller diameter than the first region.

4. Stapling device as defined in claim 1, wherein;

the bending anvil is mounted, pivotably about a bolt, on a mounting element;

the mounting element is mounted displaceably on the first region of the base member; and the bolt is guided, displaceably in the direction of movement of the stapler, in longitudinal slots of the guide element.

5. Stapling device as defined in claim 1, wherein the base member and the driver are each provided with a longitudinal groove, which align with one another in their longitudinal direction and into which the bolt engages.

6. Stapling device as defined in claim 1, wherein a compression spring with a moderate spring force, mounted on a first region, is arranged in preloaded fashion between a support surface of the base member and the mounting element.

7. Stapling device as defined in claim 1, wherein a sleeve is arranged displaceably above the mounting element and on the first region of the base member.

8. Stapling device as defined in claim 1, wherein:

the sleeve has at its one end a collar against which rests a compression spring with a higher spring force, arranged on the outside diameter of the sleeve;

a head element overlapping the sleeve is arranged displaceably at the other end of the sleeve; and the compression spring is arranged in preloaded fashion between the collar and the head element.

9. Stapling device as defined in claims 1, wherein there is arranged on the second, upper region of the base member a compression spring with a low spring force, which braces in preloaded fashion with its one end against a step to region, and with its other end against an end surface of a bore of the sleeve; and the sleeve is rigidly joined to the driver.

* * * * *